US008184837B2

(12) United States Patent
Poh

(10) Patent No.: US 8,184,837 B2
(45) Date of Patent: May 22, 2012

(54) HEARING AID WITH UV SENSOR AND METHOD OF OPERATION

(75) Inventor: Tze Chye Annie Poh, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 344 days.

(21) Appl. No.: 12/509,512

(22) Filed: Jul. 27, 2009

(65) Prior Publication Data

US 2010/0020993 A1 Jan. 28, 2010

(30) Foreign Application Priority Data

Jul. 25, 2008 (DE) ..... 10 2008 034 715

(51) Int. Cl.
*H04R 25/00* (2006.01)

(52) U.S. Cl. ..... 381/314; 381/312

(58) Field of Classification Search ..... 381/60, 381/312–315, 318–320, 322, 328
See application file for complete search history.

(56) References Cited

U.S. PATENT DOCUMENTS

| | | | |
|---|---|---|---|
| 4,741,985 | A | 5/1988 | Aoai et al. |
| 6,491,644 | B1 | 12/2002 | Vijanic et al. |
| 2002/0150264 | A1 | 10/2002 | Allegro et al. |
| 2004/0017300 | A1 | 1/2004 | Kotzin et al. |
| 2004/0138590 | A1 | 7/2004 | Jensen et al. |
| 2008/0146890 | A1 | 6/2008 | LeBoeuf et al. |

FOREIGN PATENT DOCUMENTS

| | | | |
|---|---|---|---|
| DE | 101 47 812 | A1 | 4/2003 |
| JP | 2005-149814 | A | 6/2005 |
| KR | 10-0641157 | | 11/2006 |
| WO | 00/25550 | A2 | 5/2000 |
| WO | 0147335 | A2 | 7/2001 |

OTHER PUBLICATIONS

UV-Consulting Peschl, "Meaurement Technique UV-Sensors for Monitoring of Relative UV-Intensities", Sep. 2005.

Eco-World, "Sun-Light—Das vollspektrale Leuchtmittel far die Glühbirnenfassung", Ogoniah Therapie und Regeneration, Reutlingen, Germany, Jun. 7, 2001, www.ogoniah.de (English translation of relevant parts).

Dr. Gröbel UV-Elektronik GmbH, "PLC UV/VIS-Sensoren", Ettlingen, Germany, Feb. 2007, www.uv-groebel.de (English translation of relevant parts).

Wunsch, "Kunstlicht und Gesundheit" www.international-light-association.org, www.lichtbiologie.de, 2007, pp. 46-50 (English translation of relevant parts).

European Office Action dated Oct. 15, 2009.

*Primary Examiner* — Suhan Ni

(74) *Attorney, Agent, or Firm* — Laurence A. Greenberg; Werner H. Stemer; Ralph E. Locher

(57) ABSTRACT

A hearing aid and a method for operating a hearing aid include a signal processing device operable by using different signal processing parameters and a UV sensor connected to the signal processing device. The signal processing device can set at least one signal processing parameter as a function of an output signal of the UV sensor. At least one predetermined signal processing parameter can be set in each case for within and outside of enclosed spaces. It is possible to reliably distinguish between environmental situations within and outside of enclosed spaces by using the UV light intensity in the environment to be measured by the UV sensor, so that the method of operation of the hearing aid, e.g. of an aural program, is advantageously automatically matched to these two environmental situations.

10 Claims, 1 Drawing Sheet

HEARING AID WITH UV SENSOR AND METHOD OF OPERATION

CROSS-REFERENCE TO RELATED APPLICATION

This application claims the priority, under 35 U.S.C. §119, of German Patent Application DE 10 2008 034 715.9, filed Jul. 25, 2008; the prior application is herewith incorporated by reference in its entirety.

BACKGROUND OF THE INVENTION

Field of the Invention

The invention relates to a hearing aid and a method for operating a hearing aid.

Hearing aids must be able to cope with a multiplicity of very different aural situations. To that end, it is necessary to match the transfer function of the hearing instrument to the respective aural situation. To that end, so-called behind the ear (BTE) hearing instruments have switches or buttons through the use of which it is possible to switch between different aural programs. By contrast, so-called in the ear (ITE) hearing instruments, and in particular CIC (completely in canal) instruments, either have highly miniaturized switches or buttons as a result of the small overall size of the instrument. Such switches or buttons therefore are uncomfortable to operate, or they do not include any switches or buttons and in fact rely on recognizing the respective aural situation automatically.

In order to recognize aural situations automatically and to increase wearing comfort, modern hearing aids are equipped with signal processing algorithms. They make it possible to undertake a multifaceted analysis of the acoustic environmental situation of the hearing-aid wearer. Using the results of that analysis, it is possible to match background noise reduction algorithms, directivity algorithms, beam forming, automatic program switching and other signal processing components in the hearing aid to the environmental situation.

In that context, International Publication No. WO 00/25550, corresponding to U.S. Pat. No. 6,491,644, discloses an implantable sound receptor for hearing aids. In that case, the sound sensor is constructed as an optical sensor and is disposed in the ear, at a distance from the surface of part of the sound transmission which can be excited to acoustic oscillations. Hence, the acousto-electric conversion is performed by an optical sensor.

German Published, Non-Prosecuted Patent Application DE 101 47 812 A1 discloses a hearing aid in which the matching to environmental situations is improved by analyzing the environmental situation not only on the basis of acoustic signals, but also on the basis of optical signals. Simple light/dark recognition by a photocell can be used as an optical signal. However, it is also possible for provision to be made for single or multiple brightness sensors which make it possible to detect a brightness modulation. It is also possible to make use of a sensor with a camera function, e.g. a low resolution CCD array.

SUMMARY OF THE INVENTION

It is accordingly an object of the invention to provide a hearing aid with a UV sensor and a method of operation thereof, which overcome the hereinafore-mentioned disadvantages of the heretofore-known devices and methods of this general type and through the use of which the quality of the hearing-aid therapy is increased, the user friendliness of the hearing aid is improved and a reduction in the dimensions of the housing of the hearing aid is made possible.

With the foregoing and other objects in view there is provided, in accordance with the invention, a hearing aid, comprising a UV sensor supplying an output signal and a signal processing device connected to the UV sensor. The signal processing device operates by using different signal processing parameters and the signal processing device sets at least one signal processing parameter as a function of the output signal of the UV sensor.

With the objects of the invention in view, there is also provided a method for operating a hearing aid. The method comprises measuring an intensity of a UV light in vicinity of the hearing aid to provide a measurement result, and setting a signal processing parameter of the hearing aid as a function of the measurement result.

A signal processing parameter is set by the signal processing device and hence, from the point of view of the hearing-aid wearer, it is set automatically. As a result of being set automatically, the hearing aid reacts, in a timely fashion, to different lighting conditions or changes therein. It is for this reason that signal processing parameters are also suitably set in a timely fashion and are not delayed by a delayed perception or reaction by the hearing-aid wearer. The timely reaction of the hearing aid therefore leads to a fast adaptation of the hearing-aid therapy and thus increases the quality of the latter.

Moreover, automatically adapting the hearing aid removes the need for a manual adaptation to be undertaken by the hearing-aid wearer, e.g. by manually setting a suitable signal processing parameter. Hence, this improves the user friendliness. Last but not least, the automatic adaptation of the hearing aid can also dispense with the need for a manual setting element, e.g. a program selection switch. This means that the relatively small UV sensor can replace the relatively voluminous program selection switch, and a reduction in the housing dimensions of the hearing aid can thus be achieved.

In accordance with another feature of the invention, the signal processing parameter to be set includes at least one of the following parameters:

mode of operation,
operational program, or
program parameter.

The mode of operation is intended to be understood as a method of functioning of the hearing aid, e.g. by taking into consideration different instrument environments or instrument conditions, for example when connecting a so-called audio shoe, when inserting the hearing aid into a recharging shell, when connecting a voltage supply, connecting a programming instrument, setting up wireless or wired connections to other hearing aids, when the battery voltage supply is exhausted or when different microphones or receivers (loudspeakers) are connected.

The operational program is intended to be understood as a signal processing program or a subprogram of a signal processing program for processing aural signals, e.g. by taking into consideration environmental conditions or situations, requirements of the hearing-aid wearer, aural signal input sources or hearing-aid therapy suggestions. Operational programs are usually referred to as aural programs and hearing aids usually include the possibility of selecting between a number of aural programs which are preset by programming of the hearing aid.

The program parameter is intended to be understood as a parameter setting of a mode of operation or operational program, e.g. a loudness threshold value, an acoustic degree of compression, an acoustic frequency value or frequency response, a processor clock frequency, a charging circuit for rechargeable hearing aid batteries, the ability to activate different operational programs, a frequency threshold value or intensity threshold value for the sensitivity of the UV light sensor, or the opening of a programming channel.

It is possible for the additionally available signal of the UV sensor to be particularly advantageously taken into consideration for the operation of the hearing aid by suitably selecting the signal processing parameter to be set by the signal processing device. In the process, the multiplicity of signal processing parameters which can be set advantageously increases the variety of possibilities of consideration.

In accordance with a further feature of the invention, the hearing aid includes a hearing tube for conducting electric or acoustic aural signals to the ear of a hearing-aid wearer, and the UV sensor is disposed in or on the hearing tube. Hearing aids with a hearing tube in particular are behind the ear (BTE) hearing aids, or BTE hearing aids with the receiver in the channel (BTE-RIC). The receiver is understood to mean the loudspeaker of the hearing aid and the speaker is positioned in the auditory canal of the hearing-aid wearer. Similar constellations also result for hearing aids positioned in the helix or concha of the ear, for example.

The configuration of the UV sensor on the hearing tube results in the advantage of the UV sensor not being covered by the pinna of the hearing-aid wearer, particularly in the case of BTE and BTE-RIC hearing aids. The hearing tube is usually guided from the hearing aid which is disposed behind the pinna to the auditory canal of the hearing-aid wearer through the pinna. As a result, the hearing tube partly runs above the pinna, and partly runs frontally in front of the pinna. That is the location of the places in the region of the ear which are shadowed the least by the pinna or hair so that the UV sensor can take in the surrounding light in a largely unimpeded fashion.

In accordance with an added feature of the invention, at least one predetermined signal processing parameter can be set in each case for within and outside of enclosed spaces.

The predetermined signal processing parameters can, for example, be preprogrammed during the programming of the hearing aid. They can serve as start parameter values for a self-adjusting algorithm of the signal processing so that the respectively last parameter value determined by the self-adjustment is used during the next setting of the respective parameter. They can also be programmed in, as permanently preprogrammed parameter values, e.g. during the setting of the hearing aid by the audiologist, which are used without change in each case when setting the respective parameter. Moreover, the respective parameters can be fixedly prescribed by the hearing aid hardware. Further embodiment variants are feasible.

Setting a predetermined signal processing parameter in each case for within and outside of enclosed spaces results in the advantage that a respectively matched method of functioning of the hearing aid is activated automatically for these two completely different environmental situations. In the process, the UV sensor advantageously permits a very selective detection of the respective environmental situation in a particularly easy fashion. This is because although it could seem to stand to reason to use visible light as a detection criterion, thought has to be given to the fact that visible light is also artificially generated to a quite significant intensity within enclosed spaces. It is for this reason that it is not expedient to use a light sensor operating in the frequency band of visible light. By contrast, UV light is in general not, or hardly, artificially generated within enclosed spaces. It is for this reason that the UV proportion in the surrounding light is a reliable criterion for differentiating between the two environmental situations and the UV sensor is a suitable sensor which at the same time operates highly selectively.

Other features which are considered as characteristic for the invention are set forth in the appended claims.

Although the invention is illustrated and described herein as embodied in a hearing aid with a UV sensor and a method of operation thereof, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
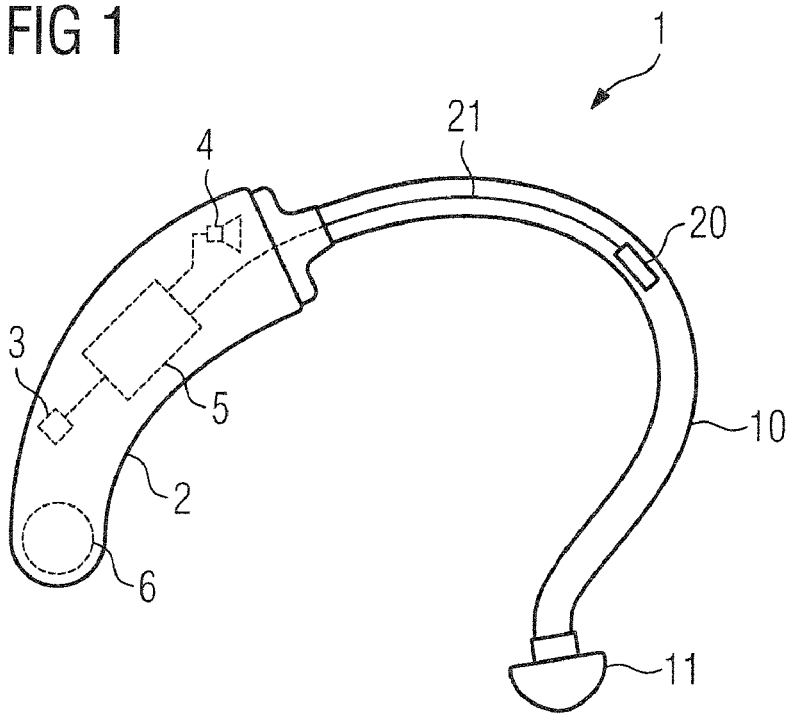
FIG. 1 is a diagrammatic, side-elevational view of a BTE hearing aid with a UV sensor.

Referring now to the figures of the drawings in detail and first, particularly, to FIG. 1 thereof, there is seen a diagrammatic illustration of a hearing aid 1 in a BTE construction. The hearing aid 1 has a housing 2 and includes a hearing tube 10. The hearing tube 10 is used to guide aural signals, that is to say acoustic output signals of the hearing aid 1, to an ear of the hearing-aid wearer. A BTE-RIC hearing aid has a similar construction although in that case the hearing tube is not used to guide acoustic signals to the ear of the hearing-aid wearer. Rather, in the case of RIC hearing aids, the hearing tube is used to guide electric signals to a receiver, i.e. a loudspeaker, positioned in the auditory canal of the hearing-aid wearer.

A so-called dome 11 is disposed at the end of the hearing tube 10. The dome 11 is a semi-circular structure made of a soft, elastic material such as silicone. It is used to position the hearing tube 10 in the auditory canal of the hearing-aid wearer and to secure it against unwanted slipping out.

A microphone 3 for recording acoustic signals is disposed in the housing 2. A line is used to connect the microphone 3 to a signal processing device 5 which is used to process the acoustic input signals. Hence, the signal processing device 5 is important for the transfer function of the hearing aid 1. Another line is used to connect the signal processing device 5 to a receiver 4 which converts the signals obtained from the transfer function into acoustic signals which are then guided further by the hearing tube 10.

A battery 6 supplies the signal processing device 5 with a supply voltage. All apparatus elements disposed within the housing 2 are indicated by dashed lines in the figure.

The signal processing device 5 is constructed to be operated in different modes of operation, with different operational programs or with different program parameters. These various possibilities of operation differ by the respectively set parameter values and in each case represent a different method for operating the hearing aid 1.

A UV sensor 20 is connected to the signal processing device 5 over a further line 21 which partly runs within the housing 2 and partly in the hearing tube 10. For optical reasons, the hearing tube 10 is generally constructed to be transparent. It is for this reason that the part of the line 21 running in the hearing tube 10 is not illustrated by a dashed line but rather by a solid line.

The hearing tube 10 is constructed to be transparent to UV light in the vicinity of the UV sensor 20. Optionally, provision can also be made for a window in the hearing tube 10 which lets UV light through to the UV sensor 20. The line 21 is used to supply output signals of the UV sensor 20 to the signal processing device 5. The latter is able to change its method of operation as a function of the output signal of the UV sensor 20, for example with respect to the mode of operation, the operational program or a program parameter. In particular, the signal processing device 5 can activate an operational program which is suitable for environments outside of enclosed spaces when a UV intensity threshold value is exceeded. This selection of the operational program is justified by the fact that increased UV sensitivity mainly occurs outside of enclosed spaces. Conversely, undershooting a UV intensity threshold value can activate an operational program suitable for enclosed spaces.

The threshold values of the UV light intensity can be changed in the signal processing device 5 or on the UV sensor 20 in order to take account of environmental conditions which are completely different, for example different altitudes or climatic zones. The frequency operational band of the UV sensor 20 is selected in a customary manner, for example in the UV-A or UV-B frequency band.

Figure 2:
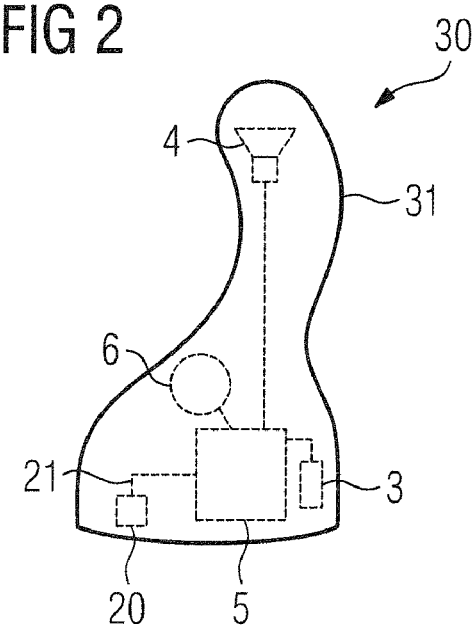
FIG. 2 is a side-elevational view of an ITE hearing aid with a UV sensor.

FIG. 2 illustrates a hearing aid 30 with an in the ear (ITE) construction. A housing 31 of the hearing aid 30, which is matched to the shape of the auditory canal of the respective hearing-aid wearer, contains, as indicated by dashed lines, a microphone 3, a receiver 4, a signal processing device 5 and a battery 6 which are all constructed as per the description above. Additionally, there is a UV sensor 20, which also is constructed as per the description above, in a part of the housing 31 facing away from the side with the auditory canal. The sensor 20 is disposed in a housing section which is either transparent to UV light or has a window for UV light. Otherwise, the method of functioning as a function of output signals of the UV sensor 20 corresponds to that described with reference to the preceding figure.

The invention can be summarized as follows: The invention relates to a hearing aid and a method for operating a hearing aid. In accordance with the invention, the hearing aid 1, 30 includes the one signal processing device 5 which is able to operate using different signal processing parameters, with provision being made for a UV sensor 20 connected to the signal processing device 5, and the signal processing device 5 being able to set at least one signal processing parameter as a function of an output signal of the UV sensor 20. Advantageously, at least one predetermined signal processing parameter can be set in each case for within and outside of enclosed spaces. It is possible to reliably distinguish between environmental situations within and outside of enclosed spaces by using the UV light intensity in the environment to be measured by the UV sensor, so that the method of operation of the hearing aid, e.g. of the aural program, is advantageously automatically matched to these two environmental situations.

The invention claimed is:

1. A hearing aid, comprising:

a UV sensor supplying an output signal;

a signal processing device connected to said UV sensor;

said signal processing device configured to operate by using different signal processing parameters including at least one of a mode of operation, an operational program or a program parameter; and said signal processing device configured to set at least one signal processing parameter as a function of said output signal of said UV sensor.

2. The hearing aid according to claim 1, which further comprises a hearing aid housing in which said UV sensor is disposed.

3. The hearing aid according to claim 1, which further comprises a hearing tube for conducting electric or acoustic aural signals to the ear of a hearing-aid wearer, said UV sensor being disposed in or on said hearing tube.

4. The hearing aid according to claim 1, wherein said signal processing parameters include at least one predetermined signal processing parameter to be set in each case for within and outside of enclosed spaces.

5. The hearing aid according to claim 1, wherein said signal processing parameters include one signal processing parameter to be set for a UV light intensity threshold value.

6. The hearing aid according to claim 1, wherein said signal processing parameters include one signal processing parameter to be set for a UV light frequency band.

7. A method for operating a hearing aid, the method comprising the following steps:

measuring an intensity of a UV light in vicinity of the hearing aid to provide a measurement result;

setting a signal processing parameter of the hearing aid as a function of the measurement result; and selecting at least one of a mode of operation, an operational program, or a program parameter as the signal processing parameter.

8. The method according to claim 7, which further comprises setting at least one predetermined signal processing parameter in each case for within and outside of enclosed spaces.

9. The method according to claim 7, which further comprises setting one signal processing parameter for setting a UV light intensity threshold value.

10. The method according to claim 7, which further comprises setting one signal processing parameter for setting a UV light frequency band.

* * * * *